US005636689A

United States Patent [19]

Rubbo et al.

[11] Patent Number: 5,636,689

[45] Date of Patent: Jun. 10, 1997

[54] RELEASE/ANTI-PRESET MECHANISM FOR DOWN-HOLE TOOLS

[75] Inventors: Richard P. Rubbo, Aberdeen, Great Britain; Brett W. Bouldin, Pearland, Tex.

[73] Assignee: Petroleum Engineering Services Ltd., Dyce, United Kingdom

[21] Appl. No.: 497,924

[22] Filed: Jul. 3, 1995

[30] Foreign Application Priority Data

Jul. 1, 1994 [GB] United Kingdom ..... 9413244

[51] Int. Cl.[6] ..... E21B 23/06

[52] U.S. Cl. ..... 166/123; 166/181

[58] Field of Search ..... 166/387, 123, 166/124, 125, 181

[56] References Cited

U.S. PATENT DOCUMENTS

| | | | |
|---|---|---|---|
| 4,438,811 | 3/1984 | Patel | 166/123 |
| 4,457,369 | 7/1984 | Henderson | 166/125 |
| 4,648,445 | 3/1987 | Caskey | 166/123 X |
| 4,712,621 | 12/1987 | Wightman et al. | 166/123 X |
| 4,984,631 | 1/1991 | Reesing | 166/123 X |

FOREIGN PATENT DOCUMENTS

| | | |
|---|---|---|
| 216417A2 | 2/1986 | European Pat. Off. . |
| 232183A2 | 6/1987 | European Pat. Off. . |
| 2091318 | 12/1981 | United Kingdom . |
| 2106963 | 9/1982 | United Kingdom . |
| 2130621 | 5/1983 | United Kingdom . |
| 2156875 | 7/1984 | United Kingdom . |
| 2164375 | 9/1985 | United Kingdom . |
| 2230804 | 4/1990 | United Kingdom . |

*Primary Examiner*—William P. Neuder

[57] ABSTRACT

This invention relates to a release/anti-preset mechanism for retrieving a down-hole tool and for preventing premature actuation of the tool during insertion thereof into a subterranean well-bore. Release mechanisms for retrieving down-hole tools are known and can be divided into three main types: shear release systems, conventional wireline/coil tubing/drill pipe (WL, CT, DP) actuated systems and hydraulically activated systems. Known mechanisms suffer from a number of problems. Accordingly the present invention provides a retrievable down-hole tool (5) having a release/anti-preset mechanism comprising first and second members (10, 15) radially releasably engagable by a third member (20) which controls radial deflection of one of the first or second members (10, 15).

9 Claims, 4 Drawing Sheets

RELEASE/ANTI-PRESET MECHANISM FOR DOWN-HOLE TOOLS

BACKGROUND OF THE INVENTION

This invention relates to a release mechanism for retrieving down-hole tools, and in particular, though not exclusively, to a packer incorporating such a releasing mechanism. This invention also relates to a (non-hydraulic) anti-preset mechanism which prevents premature actuation of a down-hole tool during insertion thereof into a subterranean well-bore.

PRIOR ART

Release mechanisms for retrieving down-hole tools are known and can be divided into three main types: shear release systems, conventional wireline/coil tubing/drill pipe (WL, CT, DP) actuated systems and hydraulically activated systems.

In shear release systems members are retained in a locked position by use of a shear or tension member(s) positioned between them. Applied forces less than the shear value may be accommodated without actuating the device. If, however, the shear value is exceeded the shear member fails permitting relative movement and release. One limitation to this system is that the shear value for practical purposes must be set relatively low in order to ensure that it will fail before components transmitting the lead exceed their operating capacity. For example, when pulling a shear release packer, the top joint in the production tubing is subject to the buoyant weight of the string in addition to applied tension, whereas the shear member placed at the bottom of the string may only be subject to applied tension less frictional losses of the tubing string within the casing string. Conversely, it may be necessary to set the shear value relatively high in order to ensure that the stresses within the shear member are kept below an acceptable level in order to ensure that the shear member does not fail under all anticipated operating conditions. In many cases these two competing requirements overlap and in these cases such a system is not viable. Another disadvantage is that accurate assessments of frictional drag of production tubing are not normally possible. An example of a shear release system for a packer is the Applicants own packer Product Ref: 722 HR.

In conventional WL/CT/DP actuated systems either collets or dogs have been used which permit the system to be loaded to values greater than the design limits of the tubing string prior to actuation. Dogs may be placed in a position between load bearing flanks of two relevant parts. The dogs are held radially in place by a support sleeve. When axial loads are applied the dog transmits the loads from one load flank to the other. The support sleeve absorbs the relatively small radial compressive forces due to the radial component of the flank angle (threads) in the outer member but is not subject to any axial loading due to applied-tubing loads. The support sleeve is held in place by a shear device. To activate the system, it is necessary to apply an independent axial load against the support sleeve to shear the screws and cause relative movement to a position in which the dogs are no longer constrained radially to engage the load flank on the external member. This external load can be applied by dedicated devices conveyed into the well on wireline, coiled tubing or on drill pipe. Collet based systems are similar to dog based systems except that the collet can be produced as an integral part of one of the members.

A disadvantage of both these systems is that it is necessary to provide seals to close off communication either through the dog windows or through the collet gaps in order to attain tubing to annular integrity. Also, although various means are usually employed to minimize the potential that wireline or coiled tubing operations will not cause the supporting sleeve to shear (high shear values, selective profiles, recessed diameters) the possibility of inadvertent release cannot be totally excluded.

Examples of a collet based release system can be found in most gravel pack seal bore packers. An example of a dog based system is the Applicants own Product Ref: AV1 CAPS.

In hydraulically activated systems a supporting member to the dog or collet is in some manner attached to or part of a piston which moves in response to exceeding a defined pressure differential. The piston could be placed between tubing and annulus and activated by differential pressure between the two. Examples include the Baker Iso-pak setting system disclosed in U.S. Pat. No. 4,936,387 and the Brown HB-S release system.

In such systems the piston seals present a potential leak path. Providing an atmospheric chamber is an option which eliminates the issue of compromising tubing to annulus integrity but also limits the practical life of the mechanism so such atmospheric systems are usually used for actions during installation (setting) rather than operations occurring after a long time such as releasing. Examples include the Baker FH and A5 packer setting systems.

In order to deal with the need to operate at higher differentials than the actuating pressure, in other words to permit selectivity, pressure access to the release piston can be isolated in various ways. Traditionally a wireline/coiled tubing activated sleeve is used. This option adds redundancy but does not eliminate the potential leak path and of course introduces possible inadvertent actuation during wireline/coiled tubing operations. An example of this type of system is the selective setting feature of the Baker FH packer. Recently the use of a tubing punch to perforate a continuous member has been used which addresses these weaknesses but requires complex systems and operations to activate the device. An example of this system is the release system of the Applicants own Product Ref: AV2 CAPS.

Often hydraulically activated anti-preset mechanisms are incorporated into hydraulically set down-hole tools to improve reliability during insertion of the tool into the well-bore. Packers are set by permitting concentric components to slide axially to expand slips and packing elements during insertion, such movement is undesirable and would be termed "presetting" the packer. In conventional anti-preset mechanisms a shifting piston is used to constrain a dog, collet, or C-ring so that an adjacent piston cannot move and is effectively locked to the mandrel. During tool insertion, the outer components are locked to the mandrel by the hydraulic anti-preset mechanism. Application of tubing pressure causes a shear pin in the shifting piston to shear, allowing movement of shifting piston to unlock the adjacent piston. The adjacent piston is now free, additional hydraulic pressure causing the piston to stroke and set the packer. This mechanism is known from Baker FH, Hydra-pak, and Iso-pak packers.

OBJECTS OF THE INVENTION

It is an object of the present invention to obviate or mitigate at least some of the aforementioned problems/disadvantages of the prior art.

SUMMARY OF THE INVENTION

According to a first aspect of the present invention there is provided a retrievable down-hole device having a release/ anti-preset mechanism comprising first and second members radially releasably engagable by a third member which controls radial deflection of one of the first or second members.

Preferably the first and second members are substantially cylindrical in cross-section, the first member being of smaller diameter than the second member.

In this case the third member may be located within the first member so as to control radial deflection thereof.

Engagement of the first and second members may be provided between co-acting recessed/proud portions on a radially outer surface of the first member and a radially inner surface of the second member.

The co-acting recessed/proud portions may be in the form of respective first and second threaded portions.

The third member may be a C-ring having a prepared slot capable of receiving a tapered pin.

The C-ring may be in the form of two concentric C-rings suitably held together.

Alternatively, the third member may be: a sleeve with recesses, a cylinder fabricated from shape memory alloy, a cylinder with a thermal insulator on the exterior, or any of a range of systems that could be manipulated into a shape With an effectively reduced outer diameter.

Preferably at least one of the first or second members defines as internal to external pressure barrier.

The retrievable down-hole device may be a packer.

According to a second aspect of the present invention there is provided a method of retrieving a retrievable down-hole device comprising the steps of:

providing the device with a release/anti-preset mechanism comprising first and second members radially releasably engaged by a third member which controls radial deflection of one of the first or second members; and controlling the third member so as to radially release the first and second members from one another thereby allowing retrieval of the tool.

BRIEF DESCRIPTION OF THE DRAWINGS

An embodiment of the present invention will now be described, by way of example only, with reference to the accompanying drawings, which are.

DETAILED DESCRIPTION OF AN EMBODIMENT

Figure 1A:
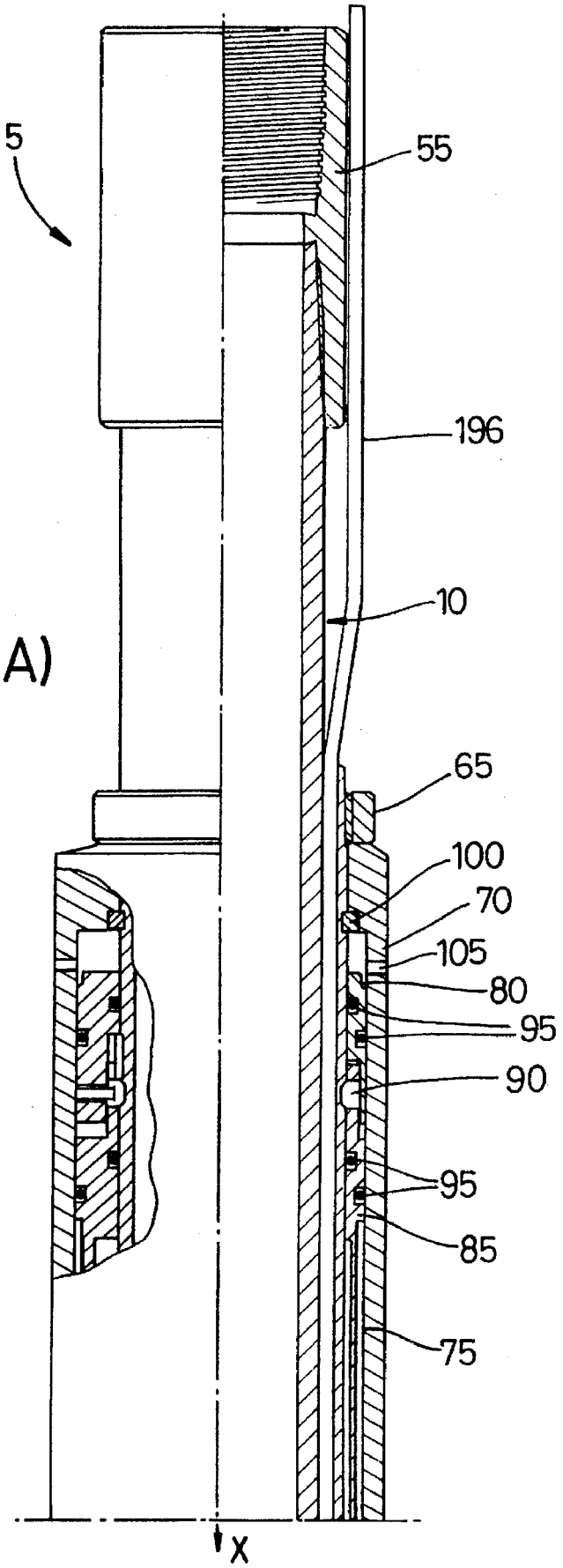
FIGS. 1(A), (B), (C) a side view in partial cross-section of a retrievable isolation packer including a release/anti-preset mechanism according to one embodiment of the present invention.
Figure 1B:
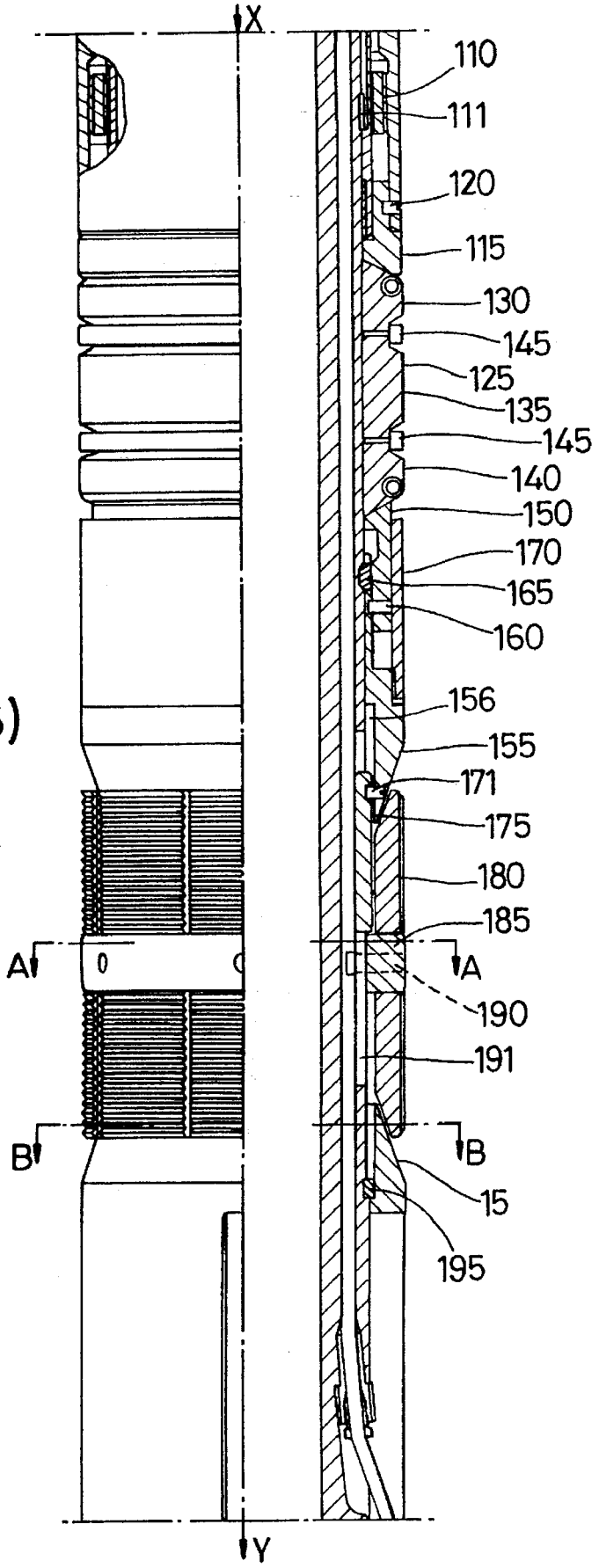

Referring now to the figures there is illustrated a retrievable down-hole tool in the form of a retrievable isolation packer, generally designated 5, having a release/anti-preset mechanism according to one embodiment of the present invention.

The release/anti-preset mechanism comprises a first member in the form of a main body or mandrel 10 and a second member in the form of a lower cone 15. The main mandrel 10 and lower cone 15 are radially releasably engagable with one another by means of a third member in the form of a C-ring 20 which controls radial deflection of the main mandrel 10.

Engagement of the main mandrel 10 and lower cone 15 is provided by means of co-acting first and second threaded portions 25, 30 on a radially outer surface of the mandrel 10 and a radially inner surface of the lower cone 15.

The C-ring 20 which has a tapered slot 35 is positioned within an inner diameter of the main mandrel 10. A tapered pin 40 can be inserted in the slot 35 so that axial movement of the pin 40 toward the C-ring 20 causes tapered surfaces of the slot 35 to move apart expanding the outer and inner diameters of the C-ring 20. Further axial movement of the pin 40 towards the C-ring 20 causes the C-ring to radially load the inner diameter of the mandrel 10.

Further similar movement causes the inner and outer diameters of the mandrel 10 to elastically deflect radially outward. The first threaded portion 25 is machined on the outer diameter of the mandrel 10, radial of the C-ring 20. Insertion of the tapered pin 40 causes the first threaded portion 25 to engage with the second threaded portion 30. Thus, once the pin 40 is inserted into the slot 35 the lower cone 15 is locked to the mandrel 10. In the above described position of the releasing mechanism, the packer 5 is run downhole.

Figure 1C:
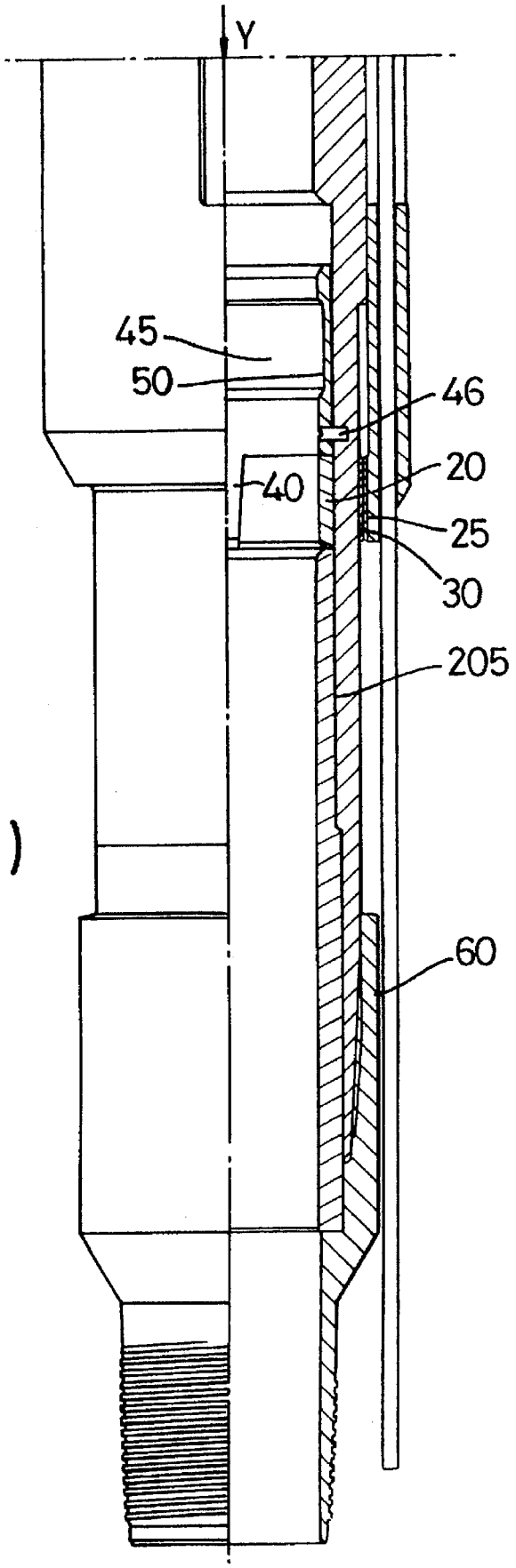
Figure 2:
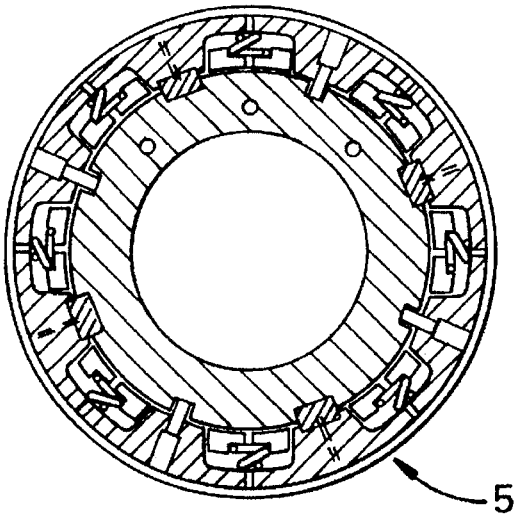
FIG. 2 a cross-sectional end view of the packer of FIG. 1 taken along line A—A.
Figure 3:
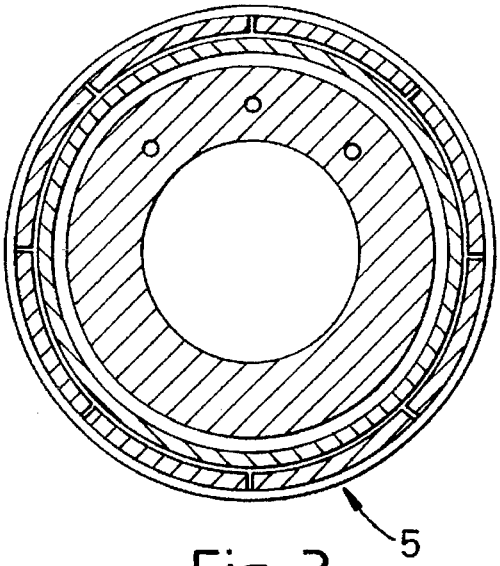
FIG. 3 a cross-sectional end view of the packer of FIG. 1 taken along line B—B.
Figure 4:
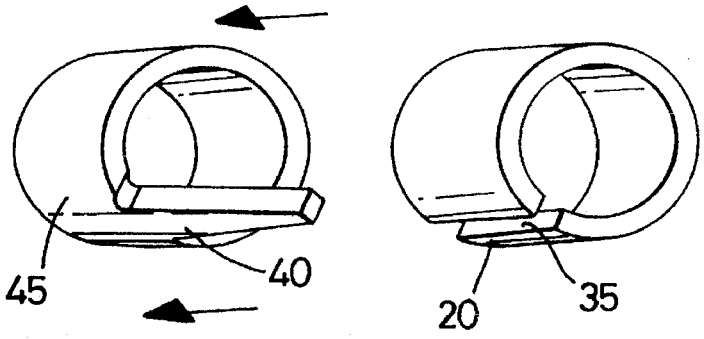
FIG. 4 a perspective view of a C-ring and tapered pin used in the packer of FIG. 1.

As can be seen from FIG. 4 the tapered pin 40 is integrally formed with an annular ring 45 which ring 45 has on an inner surface a shifting profile 50 similar to releasing (or shifting) sleeves on existing products. When a shifting tool is run in to the shifting profile the pin 40 can be pulled from the C-ring 20; the C-ring 20 thereby reduces in diameter, the mandrel 10 elastically retracts and the co-acting threaded portions 25, 30 disengage. The lower cone 15 is then free to move separate from the mandrel 10. Pulling of the packer 5 will cause the lower cone 15 to move thereby releasing the tool. As can be seen from FIG. 1(C) the annular ring 45 is, in this embodiment, shear pinned to the main mandrel 10 by shear screws 46. A preset upward jarring force must, therefore, be applied to the ring 45 by the shifting tool to shear the shear screws 46 thereby allowing retraction of the pin 40.

The above describes the release mechanism per se. A description will now be given of the packer 5 and the operation thereof.

The packer 5 is provided at an uppermost end with a threaded connector sub 55 suitable for connecting the packer 5 to drill string. The sub 55 is connected to a first end of the main mandrel 10. The packer 5 is further provided at a lowermost/innermost end with a further threaded connector sub 60 suitable for connecting the packer 5 to drill string. The further sub 60 is connected to a second end of the main mandrel 10.

A retainer ring 65 is provided near the outermost end of the main mandrel 10, which retainer ring 65 is connected thereto by threads or the like. Abutting an innermost surface of the ring 65 is an end of a cylinder 70.

The cylinder 70 provides with the mandrel 10 a cylinder chamber 75 containing a first piston 80 and a second piston 85 containing dogs 90. The pistons 80, 85 are sealed by O-rings 95. An upper stop ring 100 is provided and the cylinder 70 has a plurality of ports 105.

On a radially inner surface of the cylinder 70 at or near a lowermost end thereof there is provided a body lock ring 110. Further between radially inner and outer surfaces of the second piston 85 and mandrel 10 there is provided an anti rotation key 111. A lowermost/innermost end of the cylinder is sheer screwed to an upper gauge ring 115 by sheer screws 120. A lowermost/innermost surface of the upper gauge ring abuts an uppermost/outermost facing surface of a packing element 125. The packing element 125 comprises an end element 130, a centre element 135 and a further end element 140 spaced by element spacers 145, a lowermost/innermost facing surface of a packing element abuts a lower element insert ring 150 which is sheer screwed to an upper cone 155 by sheer screws 160. The upper cone 155 provides a plurality of lower dog segments 165. Further, on an outermost surface of the lower element insert ring 150 there is provided a lower gauge ring 170.

The upper cone 155 is sheer screwed by screw 171 to a key 175 adjacent to a plurality of slips 180 maintained in position by a slip retainer ring 185 fixed by sheer screws 190. The lower cone 15 contacts an lowermost end of the slips 180. Upward movement of the lowermost cone 15 is restricted by a lower stop ring 195 provided on an outermost surface of the mandrel 10.

A bypass line 196 runs along the length of the tool 5 which line may be used to hydraulically control further tools downline of the tool 5.

Figure 5:
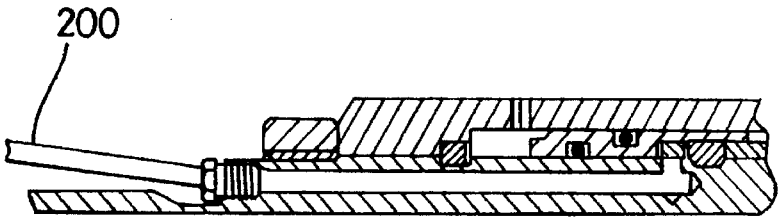
FIG. 5 a partial cross-sectional view of the packer of FIG. 1 rotated through 90°.
Figure 6:
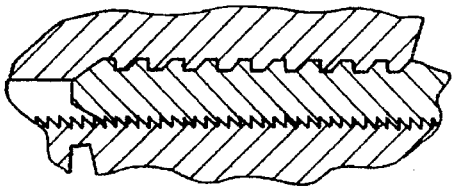
FIG. 6 a partial cross-sectional view of the packer of FIG. 1 to an enlarged scale.

As can be seen from FIG. 5 the tool 5 may be controlled by means of a setting control line 200, which communicates with an uppermost end of the second piston 85.

An inner sleeve 205 is provided within the main mandrel 10 at an end adjacent sub 60, the sleeve 205 restricting downward movement of the C-ring 20.

Operation of the tool 5 will now be described. Prior to lowering the tool 5 down-hole, the pin 40 is located in the tapered slot 35 of the C-ring 20, thereby elastically loading the C-ring 20 and the main mandrel 10 so as to connect the main mandrel 10 and the lower cone 15 via the co-acting threaded portions 25, 30. Once the tool 5 has been lowed downhole to the required position, the slips 180 and packing element 125 may be set as follows. Pressure may be applied via the setting control line 200 thereby causing upward movement of the first piston 80. Upon such movement of the first piston 80, the upper dog segments 90 may extend radially outwards thereby allowing downward movement of the second piston 85. Such movement of the second piston 85 causes shear screws 120 to shear provided the applied pressure is above a pre-determined threshold pressure. Shearing of the shear screws 120 causes downward movement of the upper gauge ring 115 thereby loading the packing element 125. Loading of the packing element 125 consequently causes shear screws 160 to shear and downward movement of the element insert ring 150. Such movement of the insert ring 150 allows the lower dog elements 165 to extend radially outwards thereby allowing downward movement of the upper cone 155 and key 175. Such movement causes shearing of shear screws 190 and thereby outward setting of the slips 180. As further force is applied downward shear screws shear causing the upper cone 155 to move free of the key 175 and finalise the setting of the slips 180.

Retrieval of the tool 5 is carried out as follows. A retrieval tool may be lowered so as to grasp the shifting profile 50 within the annular ring 45. Pulling of the setting tool in such position above the preset force shears screws 46 thereby allowing release of the pin 40 from the tapered slot 35. Consequently the diameter of the C-ring 20 reduces and elastic extension of the mandrel 10 is removed. Consequently the threaded portions 25, 30 of the lower cone 15 and mandrel 10 release from one another, and the lower cone 15 is allowed to fall away from the mandrel 10. Pulling on the packer 5 causes the mandrel 10 to move upward relative to the casing string. As the mandrel 10 is moving upward, the slips 180, and ring 185, will pick up on the lower stop ring 195 thus preventing lower ends of the slips 180 from re-engaging the lower cone 15 during retrieval. Further movement upward of the mandrel 10 causes the lower end of the key 175 to shoulder out in a slot 191, then the upper cone 155 to shoulder out in cone slot 156. This prevents the upper cone 155 from re-engaging the upper end of the slips 180 during retrieval. Further movement upward of the mandrel 10 causes the packing element 125 to relax and move downward while the second piston 85 strokes down and shoulders against the upper end of the body lock ring 110. In this way the tool 5 may be retrieved.

The embodiment of the invention hereinbefore described is given by way of example only and is not meant to limit the scope of the invention in any way. Various modifications of the disclosed embodiment may therefore, be envisaged by the skilled person without departing from the scope of the invention.

Particularly a modification to the C-ring may be that the C-ring can be provided by two separate C-rings. These separate C-rings would be machined with a slight interference then slotted and assembled concentrically, Once they are assembled they will act as a single member and can collectively be called a single C-ring.

Finally, it should be appreciated that the terms upward, downward, outermost and innermost should be construed in a common sense way with respect to a subterranean well bore per se, these terms being used for simplicity of description and not to limit the orientation of use of the tool in any way.

What is claimed is:

1. A retrievable downhole tool having a release/anti-preset mechanism, comprising:

first and second members radially releasably engageable by a third member which controls radial deflection of one of said first or second members, wherein said first and second members are substantially cylindrical in cross-section and said first member has a smaller diameter than said second member, and wherein engagement of said first and second members is provided between co-acting recessed portions on a radially outer surface of said first member and a radially inner surface of said second member.

2. A retrievable downhole tool as recited in claim 1, wherein said third member is located within said first member so as to control radial deflection thereof.

3. A retrievable downhole tool as recited in claim 4, wherein said co-acting recessed portions are in the form of respective first and second threaded portions.

4. A retrievable downhole tool as recited in claim 3, wherein said C-ring is in the form of two concentric C-rings suitably held together.

5. A retrievable downhole tool as recited in claim 1, wherein at least one of said first or second members defines an internal to external pressure barrier.

6. A retrievable downhole tool as recited in claim 1, wherein said retrievable downhole tool comprises a packer.

7. A retrievable downhole tool having a release/anti-preset mechanism, comprising:

first and second members radially releasably engageable by a third member which controls radial deflection of one of said first or second members, wherein said third member is a c-ring having a tapered slot capable of receiving a tapered pin.

8. A retrievable downhole tool having a release/anti-preset mechanism, comprising:

first and second members radially releasably engagable by a third member which controls radial deflection of one of said first or second members, wherein said third member comprises a cylinder fabricated from a shape memory alloy.

9. A retrievable downhole tool having a release/anti-preset mechanism, comprising:

first and second members radially releasably engagable by a third member which controls radial deflection of one of said first or second members, wherein said third member comprises a cylinder having a thermal insulator on the exterior of said cylinder.

* * * * *